US007547157B2

(12) United States Patent
Yodock, III et al.

(10) Patent No.: US 7,547,157 B2
(45) Date of Patent: Jun. 16, 2009

(54) BARRIER DEVICE WITH FOAM INTERIOR

(76) Inventors: Leo J. Yodock, III, 1775 Fifth St. Hollow, Bloomsburg, PA (US) 17815; Leo J. Yodock, Jr., 1517 SW. 17th St., Fort Lauderdale, FL (US) 33312; Guy C. Yodock, 3901 State Rd. 84, Apt. 206, Davie, FL (US) 33312

( * ) Notice: Subject to any disclaimer, the term of this patent is extended or adjusted under 35 U.S.C. 154(b) by 641 days.

(21) Appl. No.: 11/081,299

(22) Filed: Mar. 16, 2005

(65) Prior Publication Data

US 2005/0158119 A1 Jul. 21, 2005

Related U.S. Application Data

(63) Continuation of application No. 10/715,152, filed on Nov. 17, 2003, now abandoned, and a continuation-in-part of application No. 10/042,011, filed on Oct. 18, 2001, now abandoned.

(51) Int. Cl.
*E01F 13/00* (2006.01)

(52) U.S. Cl. ..... 404/6

(58) Field of Classification Search ..... 404/6, 404/9, 10; 256/13.1
See application file for complete search history.

(56) References Cited

U.S. PATENT DOCUMENTS

| | | | | |
|---|---|---|---|---|
| 3,606,258 | A | 9/1971 | Fitch | 256/13.1 |
| 3,698,290 | A | 10/1972 | Wallace | 404/7 |
| 3,704,861 | A | 12/1972 | Glaesener | 256/13.1 |
| 3,784,167 | A | 1/1974 | Glaesener | 256/13.1 |
| 3,856,268 | A | 12/1974 | Fitch | 256/13.1 |
| 3,876,185 | A | 4/1975 | Welch | 256/1 |
| 3,880,404 | A | 4/1975 | Fitch | 256/1 |
| 3,967,704 | A | 7/1976 | Ogden | 404/6 |
| 4,007,917 | A * | 2/1977 | Brubaker | 256/13.1 |
| 4,059,362 | A | 11/1977 | Smith | 404/6 |
| 4,307,973 | A | 12/1981 | Glaesener | 404/6 |
| 4,321,989 | A | 3/1982 | Meinzer | 188/377 |
| 4,391,077 | A | 7/1983 | Giess | 52/586.2 X |
| 4,415,680 | A | 11/1983 | Ushirokawa et al. | 521/56 |
| 4,681,302 | A | 7/1987 | Thompson | 256/13.1 |
| 4,773,629 | A | 9/1988 | Yodock et al. | 256/13.1 |
| 4,775,854 | A | 10/1988 | Cottrell | 340/566 |
| 4,869,619 | A * | 9/1989 | Akesaka | 405/184 |
| 4,917,219 | A | 4/1990 | Henry | 188/32 |
| 4,946,306 | A | 8/1990 | Yodock et al. | 404/6 |
| 5,002,423 | A | 3/1991 | Mileti | 404/6 |
| 5,052,850 | A * | 10/1991 | Bishop | 404/6 |
| 5,123,773 | A | 6/1992 | Yodock et al. | 404/6 |

(Continued)

FOREIGN PATENT DOCUMENTS

| | | |
|---|---|---|
| FR | 631 582 | 11/1989 |

(Continued)

*Primary Examiner*—Raymond W Addie
(74) *Attorney, Agent, or Firm*—GrayRobinson, PA

(57) ABSTRACT

A barrier device comprises a top wall, a bottom wall, opposed end walls and opposed side walls formed of plastic material which interconnect to form a hollow, closed interior in which the inner surface of each wall is covered with a layer of foam material and then the remainder of the hollow interior is filled with a ballast material such as water, sand, rubber, concrete and the like.

4 Claims, 5 Drawing Sheets

U.S. PATENT DOCUMENTS

| | | | | |
|---|---|---|---|---|
| 5,429,448 | A | 7/1995 | Ballesteros | 404/6 |
| 5,498,101 | A | 3/1996 | Braverman | 404/6 |
| 5,531,540 | A | 7/1996 | Wasserstrom et al. | 404/6 |
| 5,605,413 | A | 2/1997 | Brown | 404/6 |
| 5,607,252 | A | 3/1997 | Tischer | 404/6 |
| 5,882,140 | A | 3/1999 | Yodock et al. | 404/6 |
| 6,082,926 | A | 7/2000 | Zimmer | 404/6 |
| 6,152,064 | A | 11/2000 | Morton | 114/361 |
| 6,179,516 | B1 | 1/2001 | Ivey et al. | 404/6 |
| 6,221,928 | B1 | 4/2001 | Kozma et al. | 521/86 |
| 6,666,616 | B2 * | 12/2003 | Yodock et al. | 404/6 |
| 2002/0025221 | A1 * | 2/2002 | Johnson | 404/6 |

FOREIGN PATENT DOCUMENTS

| | | |
|---|---|---|
| GB | 2 292 404 | 2/1996 |

* cited by examiner

BARRIER DEVICE WITH FOAM INTERIOR

This is a continuation Ser. No. 10/715,152 filed on Nov. 17, 2003 which claims priority under 35 U.S.C. §120 now abandoned.

RELATED APPLICATION

This application is a continuation-in-part of U.S. patent application Ser. No. 10/042,011, filed Oct. 18, 2001 now abandoned and entitled "BARRIER DEVICE WITH FOAM INTERIOR," which claims priority under 35 U.S.C. § 120 for all commonly disclosed subject matter.

FIELD OF THE INVENTION

This invention relates to barrier devices for vehicular and vessel traffic control, soil erosion containment, impact attenuation and the like which can be interconnected with one another to define a barrier wall structure and/or connected in various combinations to form energy-absorbing cells, and, more particularly, to barrier devices formed of a light weight plastic having a hollow interior whose inner surface is covered with a foam layer and then filled with a ballast material such as water, sand, concrete, rubber and the like.

BACKGROUND OF THE INVENTION

A variety of different devices have been developed for absorbing the kinetic energy resulting from impact with a moving vehicle, and for the containment of forces exerted by soil or water. Highway barriers, for example, are intended to provide a continuous wall or barrier along the center line or shoulder of a highway when laid end-to-end to absorb grazing blows from moving vehicles. One commonly used highway barrier is formed of pre-cast reinforced concrete, and is known as the "Jersey" style barrier. Highway barriers of this type have a relatively wide base resting on the pavement or shoulder of the highway; opposed side walls and opposed end walls. The side walls consist of a "curb reveal" extending vertically upwardly from the base a short distance, a vertically extending top portion connected to the top wall of the barrier and an angled portion between the curb reveal and the vertical top portion. This design is intended to contact and redirect the wheels of a vehicle in a direction toward the lane of traffic in which the vehicle was originally traveling, instead of the lane of opposing traffic. See, for example, U.S. Pat. No. 4,059,362.

One problem with the Jersey-style highway barriers described above is the weight of reinforced concrete. A concrete barrier having a typical length of twelve feet weighs about 2,800-3,200 pounds, and requires special equipment to load, unload and handle on site. It has been estimated that for some road repairs, up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicle.

In an effort to reduce weight, facilitate handling and shipment, and provide improved absorption of vehicle impact forces, highway barriers have been designed which are formed of a hollow plastic container filled with water, sand or other ballast material such as disclosed in U.S. Pat. Nos. 4,681,302; 4,773,629; 4,846,306, 5,123,773 and 5,882,140. For example, the '302 patent discloses a barrier comprising a housing having a top wall, bottom wall, opposed side walls and opposed end walls interconnected to form a hollow interior which is filled with water. The ends of each barrier couple to an adjacent barrier to form a continuous wall. The container structure is preferably formed of a resilient, plastic material which is deformable upon impact and capable of resuming its original shape after being struck. The container further includes longitudinally extending, spaced traction spoiler channels which are intended to reduce the area of potential impact, and thus the tendency of the vehicle to climb the walls of the barrier and vault over it into the opposing lane of traffic.

The '629, '306, '773 and '140 patents noted above represent further advances in deformable highway barrier designs. The first two patents disclose barriers which comprise a longitudinally extending housing made of semi-rigid plastic which is self-supporting, and has a predetermined shape which is maintained when filled with water, sand or other ballast material. Such devices are connected end-to-end by a key insertable within grooves formed in the end walls of adjacent barriers. Interconnected fill openings are provided which permit adjacent barriers to be filled with water or other ballast material when laid end-to-end.

The '773 and '140 patents disclose further improvements in barrier devices including side walls formed with higher curb reveals, a horizontally extending step and vertical indentations in order to assist in maintaining the structural integrity of the container, and internal baffles for dampening movement of water or other ballast material within the container interior. Interlocking male and female coupling elements are formed on the opposite end walls of each barrier to facilitate connection of adjacent barriers end-to-end. Additionally, channels or openings are formed in the barriers from one side wall to the other to permit the insertion of the tines of a fork lift truck therein for easy loading, unloading and handling of the barriers.

Despite improvements to highway barrier of the type described above above, some deficiencies nevertheless remain. One problem involves leakage of ballast material from the barrier interior. It has been found that defects can occur in the walls and in the joints between adjacent walls during the process of molding plastic barriers. Additionally, the plastic barriers can be relatively easily punctured on the job site by fork lift trucks or other equipment. Water is the most commonly used ballast material, and cracks or other defects in the barrier walls causes leakage which results, over time, in the complete drainage of water from the barrier. It is time consuming and inefficient to replace a leaking barrier along the length of the barrier wall, and repairs to individual barriers are inconvenient and expensive.

Another problem with highway barriers, both those formed of concrete and barriers having walls made of plastic material, relates to attenuation of the force of an impact with a moving vehicle. As noted above, concrete barriers have little or no ability to absorb or attenuate the force resulting from impact with a vehicle. If a vehicle grazes the concrete barrier at a shallow angle it essentially "bounces off" of the barrier and is turned back into traffic in the direction the vehicle was originally moving. Contact with a concrete barrier at a sharper angle can cause severe damage to the vehicle, and injury to its occupants, since the force of impact must be absorbed virtually entirely by the bumpers, side panels and other parts of the vehicle.

Highway barriers formed with plastic walls and filled with a ballast material such as water are more effective in absorbing the force of impact with a vehicle than concrete barriers. However, it has been found that the plastic material forming the barrier walls either breaks apart upon impact with a vehicle, or provides what can be characterized as a "rebound"

effect. Instead of absorbing a vehicle impact so that the force is attenuated or transferred throughout the barrier device, the plastic material forming the barrier walls tends to deflect in the localized area of impact and then return or rebound to its original shape with the assistance of the ballast material in the hollow interior of the barrier device. Such rebound or return motion exhibited by the plastic walls exerts a force on the vehicle tending to stop or slow it down relatively quickly, or abruptly change the direction of movement of the vehicle, which, in turn, is transferred to the occupants of the vehicle.

SUMMARY OF THE INVENTION

The barrier device of this invention comprises a top wall, a bottom wall, opposed end walls, and, opposed side walls formed of a plastic material which are interconnected to form a closed, hollow interior. The inner surface of each wall is covered with a layer of foam material forming a unitary foam structure within the hollow interior, and the remainder of the hollow interior receives a ballast material such as water, sand, rubber, concrete and the like.

In one presently preferred embodiment of this invention, a rotational molding process is employed to combine crosslinkable high density polyethylene material with polyethylene foaming pellets to form the barrier device noted above with walls having an interior surface covered with a layer of foam. The plastic, polyethylene walls have a thickness on the order of about 0.25 inches, and the foam layer is in the range of 0.5 to 6 inches in thickness depending upon the amount of foaming pellets used. Fill holes are formed in the top wall of the barrier so that water, sand or other ballast material can be introduced into the hollow interior and into contact with the foam layer.

Unlike prior barrier devices formed with plastic walls, the barrier of this invention is highly resistant to leakage of ballast material from its hollow interior due to the presence of the foam layer. Even if cracks or other openings develop in the plastic walls or joints of the barrier, the foam layer is effective to seal these irregularities and substantially prevent leakage of the ballast material. Further, the barrier devices with the foam layer of this invention are resistant to puncture by fork lift tines or other equipment employed in their installation or transport.

Additionally, the construction of the barrier device of this invention distributes and attenuates the force of impact with a colliding vehicle better than prior art barriers. The unitary foam layer extending along the surface of each wall within the closed, hollow interior of the barrier enhances the structural integrity of the barrier, and assists in transferring the force of a collision with a vehicle beyond the area of immediate impact to achieve improved overall force attenuation.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
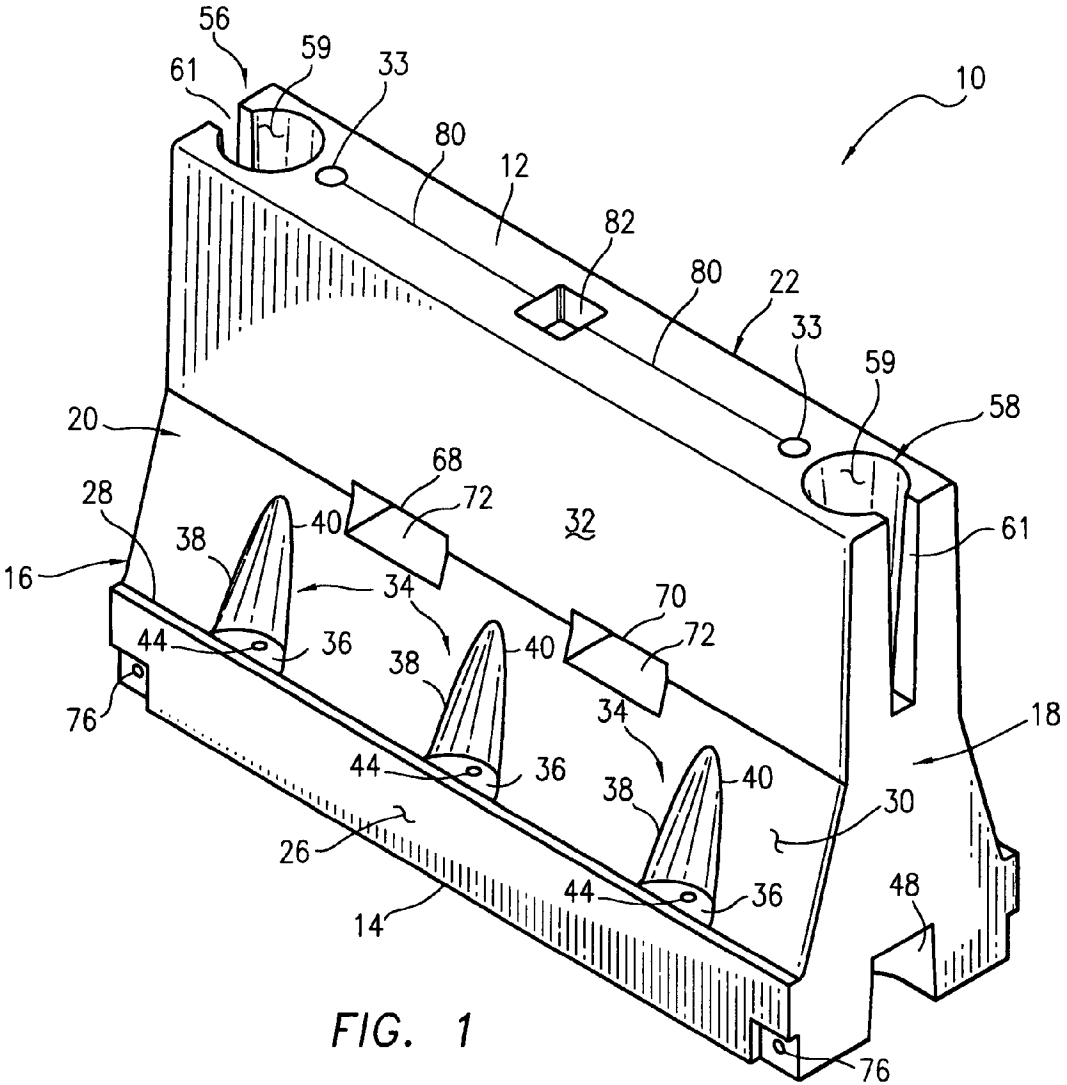
FIG. 1 is a perspective view of the barrier of this invention.

Referring initially to FIGS. 1-4, the barrier device 10 of this invention comprises a top wall 12, a bottom wall 14, opposed end walls 16, 18, and, opposed side walls 20, 22 which are interconnected to collectively define a hollow interior 24. In the presently preferred embodiment, each of the walls 12-22 are formed of a semi-rigid plastic material chosen from the group consisting of low density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact therewith. Additionally, materials of this type are unaffected by weather and have excellent basic resistance to weathering, leaching and biodegradation. Additives such as ultraviolet inhibitors can be combined with such plastic materials, making them further resistant to the effects of weather. They also retain their mechanical and chemical properties at low ambient temperatures.

When using the barrier device 10 of this invention as a highway barrier, the hollow interior 24 is preferably filled with a "ballast" material such as water or other liquid, or a flowable solid material such as sand, concrete and the like. For this purpose, the walls 12-22 of barrier device 10 have a thickness in the range of about one-eighth inch to one inch so as to perform satisfactorily in service. The barrier device 10 is preferably in the range of about six to eight feet in length, and, at the wall thickness noted above, has a weight when empty of about 80 to 140 lbs. When filled with a liquid such as water, the overall weight of the barrier is in the range of about 1400 to 2200 lbs. Flowable solid material such as sand and the like increase the weight of barrier 10 further.

For ease of understanding and discussion of the principal aspects of this invention, the various structural elements of the barrier device 10 are described below in relation to their collective performance of a particular function of the barrier 10. These functions include the ability of the barrier 10 to better redirect and control the upper movement of a vehicle upon impact therewith, the ability to resist lateral separation of adjacent barriers 10 when they are joined end-to-end to form an essentially continuous wall, the ability to resist leakage of the ballast material from the hollow interior of the barrier, and the ability to attenuate the force of impact with a vehicle.

Control of Vehicle Movement

The control of vehicle movement upon impact with the barrier device 10 of this invention is achieved primarily by the material with which the barrier 10 is constructed, and the configuration of its side walls 20 and 22. Because both side walls 20, 22 are identical in configuration, only side wall 20 is described in detail herein, it being understood that the side wall 22 is formed with the identical structure and functions in the same manner.

The side wall 20 includes a substantially vertically oriented curb reveal 26 located between the bottom wall 14 and a horizontally extending ledge or step 28 best shown in FIG. 1. Preferably, the curb reveal 26 has a vertical height of nine inches, measured from the bottom wall 14 upwardly, which is at least two inches greater than the curb reveals of other highway barrier devices, such as disclosed, for example, in U.S. Pat. No. 5,123,773. The horizontal extent of the step 28 is preferably on the order of about 1½ inches measured in the direction from the outer edge of curb reveal 26 toward the hollow interior 24 of barrier device 10.

Extending upwardly at an acute angle from the step 28 is an intermediate section 30 which terminates at a vertical upper section 32. The upper section 32, in turn, extends from the intermediate section 30 to the top wall 12 of barrier 10 which is formed with a pair of fill holes 33 preferably having a diameter in the range of about 3-4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. As best seen in FIG. 1, the base 36 of each stabilizer 34 is coplanar with the step 28 and is supported by an internally located support 42 shown in phantom lines in FIG. 3. The sides 38, 40 of each stabilizer 34 taper inwardly, toward one another, from the base 36 to a point substantially coincident with the uppermost edge of intermediate section 30 where the upper section 32 of side wall 20 begins. In the presently preferred embodiment, a through bore 44 extends from the base 36 of one or more of the stabilizers 34, through the internal support 42 and out the bottom wall 14 of barrier 10. One or more of these through bores 44 receive an anchoring device such as a stake 46, shown in phantom in FIG. 3, which can be driven into the ground, highway or other surface upon which the barrier device 10 rests to secure it in an essentially permanent position thereon.

Enhanced control and redirection of the path of a vehicle impacting the barrier device 10 of this invention is achieved with the above-described structure as follows. The increased height of the curb reveal 26 of side wall 20, e.g., nine inches compared to seven inches or less for conventional barriers, is effective to engage and redirect the tires of a vehicle toward the lane in which the vehicle was traveling instead of in a direction toward the barrier 10 or the opposing lane of traffic. The curb reveal 26 is strengthened and reinforced by the presence of the horizontal ledge or step 28 and the stabilizers 34.

In the event the vehicle tires nevertheless extend above the curb reveal 26 upon impact, the intermediate and upper sections 30 and 32 are designed to resist further upward movement of the vehicle therealong. While the stabilizers 34 in intermediate section 30 function to add rigidity and stability to the overall barrier 10, the intermediate section 30 is nevertheless designed to at least partially collapse inwardly or buckle in response to the application of an impact force thereto. The extent of inward motion of buckling is controlled, at least to some extent, by the diameter of the fill holes 33 in the top wall 12. When the barrier interior 24 is filled with water, for example, the impact of a vehicle with a barrier side wall 20 or 22 causes such water to displace from the area of contact. Some of the water is forcefully discharged from the interior 24 through the fill holes 33, and the amount of such energy displacement is dependent on the diameter of the holes 33. The greater the diameter, the greater the amount of water displaced, and, hence, the more the barrier side wall 20 or 22 is permitted to buckle. It has been found that a fill hole 33 diameter of about 3-4 inches, noted above, is optimum wherein sufficient buckling of the side walls 20, 22 is permitted for the purposes described below without permanent damage to the barrier 10 upon impact with a vehicle. In the presently preferred embodiment, when the intermediate section 30 buckles inwardly, a pivot point is created about which the upper section 32 can move in a generally downward direction. Consequently, the tire and/or bumper of the vehicle is impacted by the upper section 32 of barrier device 10 and urged downwardly, back toward the pavement or ground along which the vehicle was traveling. This substantially prevents the vehicle from vaulting over the top of the barrier 10 and entering the opposing lane of traffic. Despite such movement of the intermediate and upper sections 30, 32 in response to impact, the material from which barrier device 10 is constructed allows such sections 30, 32 to return to their original shape after deformation.

Resistance to Barrier Disengagement

Figure 4:
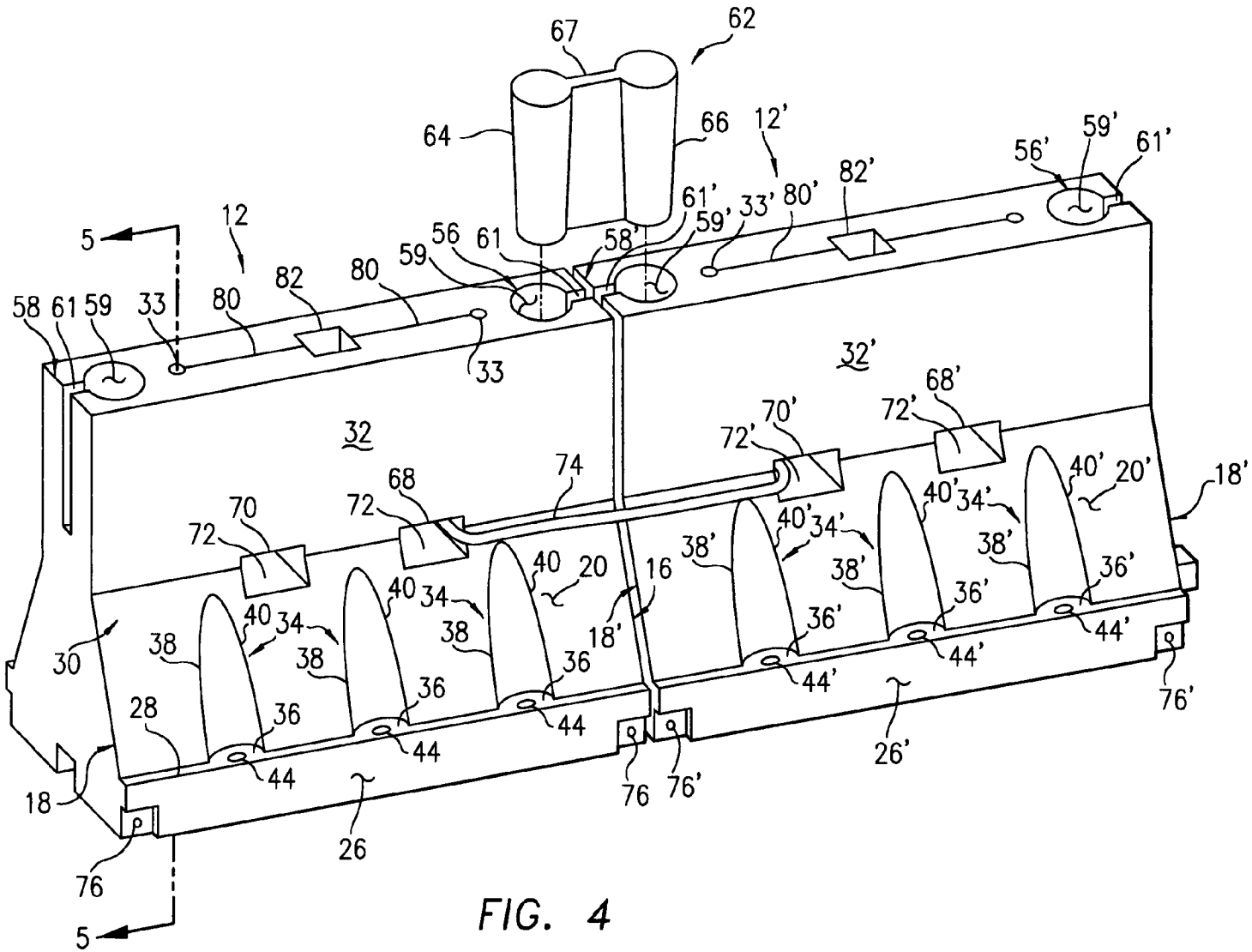
FIG. 4 is a perspective view of two barriers connected end-to-end.

Another general aspect of the construction of the barrier device 10 of this invention involves a number of elements designed to resist disengagement of adjacent barrier devices 10 and 10' when they are arranged end-to-end to form an essentially continuous wall. Two barrier devices 10 and 10' are depicted in FIG. 4, which are identical in structure and function. The same reference numbers are therefore used to identify like structure, with the addition of a "'" to the numbers associated with barrier 10' on the right-hand side of FIG. 4.

Each end wall 18 of barriers 10 is formed with an internally extending recess 48 near the bottom wall 14, which receives an outwardly protruding extension 52 formed on the end wall 16 of an adjacent barrier 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

Figure 2:
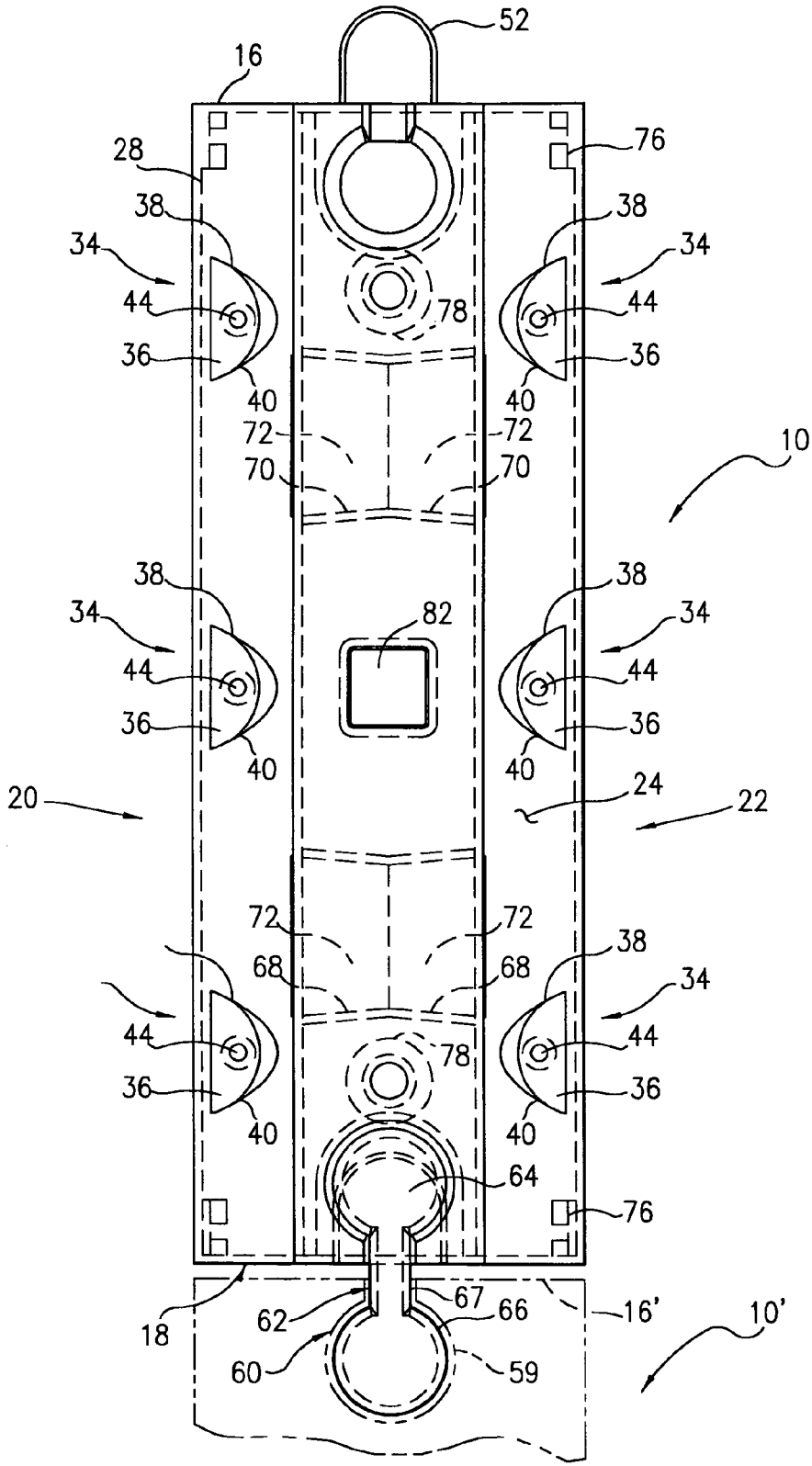
FIG. 2 is a plan view of the barrier depicted in FIG. 1, with a second barrier shown in phantom at one end.
Figure 3:
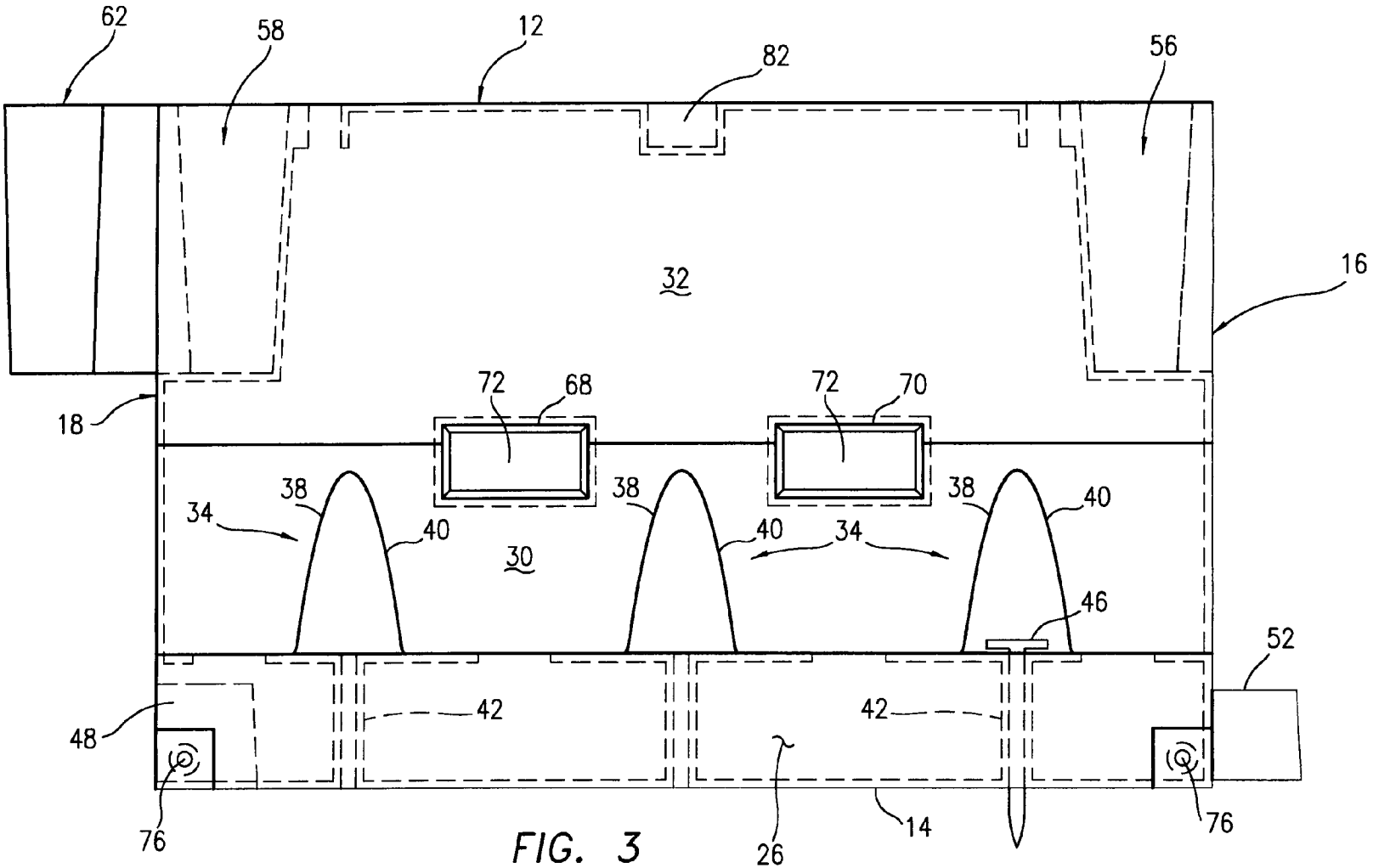
FIG. 3 is a side view of the barrier of FIG. 1.

When two barrier devices 10 and 10' are oriented end-to-end, with the end wall 16 of one barrier 10 abutting the end wall 18' of an adjacent barrier 10', the slots 56, 58 collectively form a barbell-shaped locking channel 60 shown in FIG. 4 and also depicted in phantom at the bottom of FIG. 2. This locking channel 60 receives a coupler 62 having cylindrical ends 64, 66 and a rectangular center section 67, which is removably insertable therein and extends substantially along the entire length of the locking channel 60. The cylindrical ends 64, 66 of coupler 62 pivot within the correspondingly shaped cylindrical portions 59, 59' of slots 56, 58', so that one barrier device 10 can be pivoted with respect to an adjacent barrier 10' to assist with alignment thereof, and to allow the barriers 10, 10' when placed end-to-end to follow curves along a particular highway or other location where they are placed.

Additionally, a pair of hollow sleeves 68 and 70 are located within the hollow interior 24 of barrier device 10 and extend between the side walls 20, 22. A portion of both sleeves 68, 70 is located in the intermediate section 30 of each side wall 20, 22, and extends partially into the upper sections 32 thereof. The two sleeves 68, 70 are positioned in the spaces between the three stabilizers 34 formed in the side walls 20, 22, and provide added internal support to the barrier 10 so that it retains its shape when filled with a ballast material.

Each of the sleeves 68 and 70 define a pass-through hole or channel 72 adapted to receive the tines of a forklift truck to permit handling of the barriers 10. Moreover, a strap 74 (see FIG. 4) can be extended between the channel 72 of sleeve 68 in one barrier 10 and the channel 72 of sleeve 70' in an adjacent barrier 10', and then tightened down, to urge such barriers 10, 10' together and provide additional resistance to disengagement of adjacent barriers 10, 10'. It is believed that the combination of: (1) the extension 52—recess 48 connection; (2) the coupler 62 and locking channel 60 engagement; (3) the straps 74; and, (4) the stake(s) 46 or other anchoring device secured within the through bores 44 noted above, collectively provides improved resistance to disengagement between adjacent barriers 10 compared to prior barrier designs.

In the presently preferred embodiment, a drain hole 76 is formed along each of the end walls 18 and 20 thereof near the bottom wall 14 to allow passage of water and the like from one side of the barrier device 10 to the other. Water or other flowable material is introduced into the hollow interior 24 of the barrier device 10 via the fill holes 33 formed in top wall 12. These fill holes 33 can also receive the post of a sign or the like (not shown) extendable into the barrier interior 24. As shown in FIG. 2, a post boot 78 is formed at the bottom wall 14 of barrier 10, in alignment with each fill hole 33, to receive and support the post of a sign inserted through the fill hole 33. Preferably, the top wall 12 is formed with an elongated channel 80 leading to each fill hole 33 to allow for the flow of rainwater into the hollow interior 24. The top wall 12 is also formed with an internally extending seat 82 which is adapted to mount an internal light fixture (not shown) for illuminating the barrier device 10 from the inside. The details of such lighting construction form no part of this invention and are thus not discussed herein.

Resistance to Leakage of Ballast Material

Figure 5:
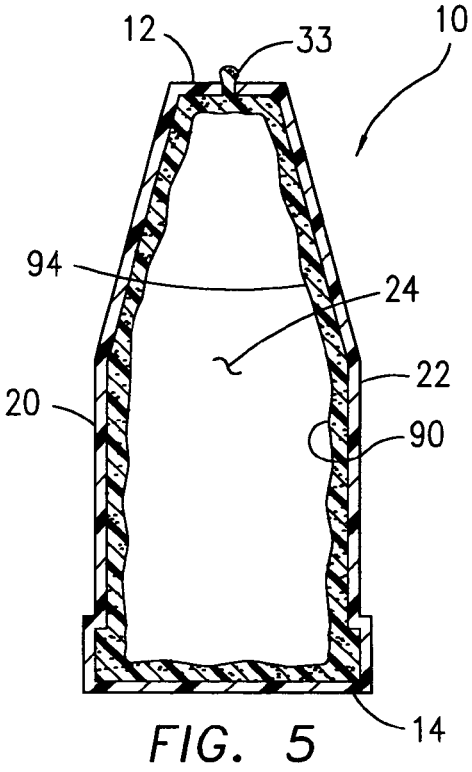
FIG. 5 is a cross sectional view of the barrier shown in FIG. 1 depicting a foam layer along the walls within the barrier interior.

With reference to FIG. 5, in one preferred embodiment of this invention structure is provided to resist leakage of ballast material from the hollow interior 24 of the barrier device 10. Each of the walls 12, 14, 16, 18, 20 and 22 is formed with an inner surface 90 located within the hollow interior 24 and an exterior, outer surface 92. These inner surfaces 90 each receive a foam layer 94 having a thickness in the range of about 0.5 to 6 inches. The remainder of the hollow interior 24 is open and can be filled with ballast material through fill holes 33 in the manner described above. The foam layer 94 is effective to seal the inner surface 90 of each wall and substantially prevent leakage of ballast material from the hollow interior 24. Additionally, the foam layer 94 is puncture resistant, particularly as its thickness is increased, and therefore resists leakage of ballast material even if the plastic walls of the barrier are damaged by fork lifts or other equipment during transit or assembly of the barriers 10.

The method of forming the barrier device 10 with the foam layer 94 forms no part of this invention, and is therefore not discussed in detail herein. Generally, a rotational molding process is employed in which a polyethylene resin and polyethylene foaming pellets are combined in a mold to form the completed barrier. Each of the walls 12, 14, 16, 18, 20 and 22 is therefore formed of a high density polyethylene using this molding technique, preferably having a thickness on the order of about 0.25 inches. One type of polyethylene resin suitable for forming the plastic walls of the barrier 10 are commercially available from ExxonMobil Chemical under the trademark "PAXON," Type Numbers 7004 and 7204 rotational molding resins.

One foam material which can be employed in the rotational molding process noted above to form the foam layer 94 is commercially available from Equistar Chemicals, Inc. of Houston, Tex. under the trademark "PETROTHENE." A structural foam, semi-rigid foam or flexible PETROTHENE foam may be employed in the barrier 10 of this invention, whose properties and type numbers are as follows:

| Property | Nominal Value | Units |
|---|---|---|
| MSTR005 - Structural Foam | | |
| Density | 7 | $lb/ft^3$ |
| Compressive Modulus | 800 | psi |
| Shrinkage (w/MSTR003, 4 skin) | 0.010-0.015 | in/in |
| Thermal Conductivity (k) | 0.435 | BTU in/hr $ft^2$ ° F. |
| MSTR008 - Semi-Rigid Foam | | |
| Density | 4 | $lb/ft^3$ |
| Compressive Modulus | 180 | psi |
| Shrinkage (w/MSTR003, 4 skin) | 0.010-0.015 | in/in |
| Thermal Conductivity (k) | 0.384 | BTU in/hr $ft^2$ ° F. |
| MSTR007 - Flexible Foam | | |
| Density | 2 | $lb/ft^3$ |
| Compressive Modulus | 35 | psi |
| Shrinkage (w/MSTR003, 4 skin) | 0.010-0.015 | in/in |
| Thermal Conductivity (k) | 0.357 | BTU in/hr $ft^2$ ° F. |

In most instances it is contemplated that a semi-rigid foam would be employed to form the foam layer 94, such as PETROTHENE Type No. MSTR008, depending on the particular application for which the barrier device is intended. If additional structural rigidity is required, a denser foam with increased compressive modulus may be used such as PETROTHENE Type No. MSTR005. Further, the overall thickness of the foam layer 94 can be controlled in the molding process to increase or decrease the rigidity of the barrier 10, i.e., the thicker the foam layer 94 the more rigid the walls 12-22.

Enhanced Impact Force Attenuation

Figure 6:
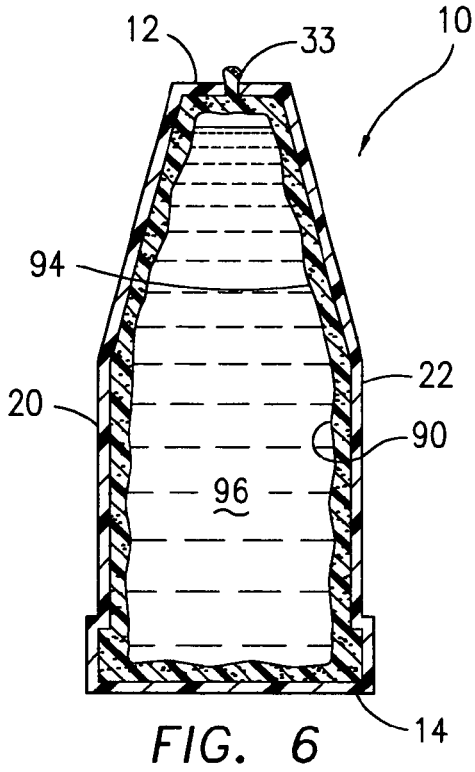
FIG. 6 is view similar to FIG. 5 except with the hollow interior of the barrier at least partially filled with a ballast material.

Referring again to FIG. 5, and to FIG. 6, it is noted that the foam layer 94 covers the inner surface 90 of each of the top wall 12, bottom wall 14, end walls 16, 18 and side walls 20, 22 thus forming a unitary structure within the hollow interior 24 which is essentially continuous except for the fill holes 33 in the top wall 12. The hollow interior 24 is then at least partially filled with a ballast material 96 such as water shown in FIG. 6.

In prior art designs where no foam layer is present and the plastic side walls of a barrier directly contact the ballast material, the force of a vehicle impact tends to be localized in the area of contact. The impacted wall buckles in that area, and, as noted above, ballast material is displaced in response to buckling of the wall. Where water is employed as the ballast material, it is forced out of the fill holes in the barrier. In prior art plastic barriers, if the impacted wall does not break apart, it tends to abruptly rebound to its original shape thus exerting a relatively high return force on the vehicle which impacted it. This return force can damage the vehicle, and cause injury to its passengers.

The presence of the foam layer 94, and its unitary construction within the hollow interior 24, substantially enhance the force attenuation characteristics of the plastic walls 12-22. The unitary construction of the foam layer 94, wherein it extends continuously along the inner surface 90 of each of the walls 12-22 except for the fill holes 33, tends to distribute the force of a vehicle impact throughout the entire barrier 10 instead of just in the localized area of impact. For example, the force of an impact of a vehicle with side wall 22 is distributed at least to some extent by the foam layer 94 to the top wall 12, bottom wall 14 and both end walls 16, 18 because of their direct connection through foam layer 94 to the side wall 22, and also to side wall 20 because of its connection to the foam layer 94 along the other walls 12, 14, 16 and 18. This unitary construction of the foam layer 94 enhances the overall structural integrity of the barrier 10, provides for improved attenuation of the applied force and aids in preventing the impacted wall from breaking apart under the force of contact with a vehicle.

Additionally, it has been found that the presence of foam layer 94 reduces the magnitude of the return or rebound force exerted by an impacted wall compared to the prior art. In response to contact with a vehicle, the plastic material forming the side wall 22, for example, and the foam layer 94 connected to the side wall 22, collectively collapse or buckle inwardly toward the hollow interior 24 and then return to their original shape. The extent and abruptness with which the plastic material forming side wall 22 buckles and rebounds is lessened by the presence of the foam layer 94, i.e., the foam layer 94 buckles and rebounds at a different, slower rate than the plastic, and to a lesser extent than the plastic. As a result, the return or rebound force exerted by the barrier 10 against the vehicle which impacted it is reduced, which, in turn, is safer for the passengers of the vehicle.

Attenuation of forces applied to the barrier 10 is also assisted by the presence of the ballast material 96, and the fact that it is contained within interior 24 which is substantially closed. If the top wall 12 of the barrier 10 was eliminated, for example, impact with a vehicle would cause any ballast material carried by the barrier to immediately escape, thus severely limiting the force attenuation capacity of the barrier 10. The closed interior 24 of barrier 10 confines the ballast material 96, allowing it to assist in force attenuation. The degree of attenuation contributed by the ballast material 96 within the closed interior 24 of the barrier 10 can be adjusted to some extent by varying the size of the fill holes 33 or by closing them entirely. As noted above, when using water as a ballast material 96, impact by a vehicle with the barrier 10 causes some of the water to be displaced from the area of contact and escape through the fill holes 33. The smaller the fill holes 33, the greater the resistance to displacement of the ballast material 96 which causes the barrier walls 12-22 to exhibit increased "stiffness" or resistance to buckling. Maximum stiffness is obtained with the closed interior 24 completely filled with ballast material 96 and the fill holes 33 closed.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A barrier device, comprising:

a top wall, a bottom wall, opposed side walls and opposed end walls interconnected to form a hollow, closed interior, each of said walls having an inner surface located within said hollow, closed interior and an outer surface;

a layer of foam material substantially entirely covering said inner surface of each of said top wall, said bottom wall, said opposed side walls and said opposed end walls, said layer of foam material forming a unitary structure within said hollow, closed interior which is affixed to each of said walls to enhance the structural integrity of said walls, an open area being formed within said hollow, closed interior which is bounded by said layer of foam material extending along each of said top wall, said bottom wall, said opposed side walls and said opposed end walls;

a ballast material at least partially filling said open area, said layer of foam material being effective to resist leakage of ballast material from said open area within said hollow, closed interior through said walls.

2. The barrier device of claim 1 in which said layer of foam material formed along each of said top wall, said bottom wall, said opposed side walls and said opposed end walls has a thickness in the range of about ½ to 6 inches.

3. A barrier wall, comprising:

a number of individual barrier devices, each of said barrier devices including:

(i) a top wall, bottom wall, opposed side walls and opposed end walls interconnected to form a hollow, closed interior, each of said walls having an inner surface located within said hollow, closed interior and an outer surface;

(ii) a layer foam material substantially entirely covering said inner surface of each of said top wall, said bottom wall, said opposed side walls and said opposed end walls, said layer of foam material forming a unitary structure within said hollow, closed interior which is affixed to each of said walls to enhance the structural integrity of said walls, an open area being formed within said hollow, closed interior which is bounded by said layer of foam material extending along each of said top wall, said bottom wall, said opposed side walls an said opposed end walls;

a ballast material at least partially filling said open area of each of said barrier devices, said layer of foam material within each of said barrier devices being effective to resist leakage of ballast material from said open area within said hollow, closed interior through said walls;

a coupling device which connects said individual barrier devices together end-to-end.

4. The barrier wall of claim 3 in which said layer of foam material formed along said inner surface of each of said top wall, said bottom wall, said opposed side walls and said opposed end walls of each barrier device has a thickness in the range of about ½ to 6 inches.

* * * * *